United States Patent [19]

Nigg et al.

[11] Patent Number: 5,024,162

[45] Date of Patent: Jun. 18, 1991

[54] CABLE TRANSPORT APPARATUS

[75] Inventors: Ernst Nigg; Elmar B. Fuchs, both of Schwarzach, Austria

[73] Assignee: Konrad Doppelmayr & Sohn Maschinenfabrik Gesellschaft m.b.H. & Co. KG, Wolfurt, Austria

[21] Appl. No.: 474,457

[22] Filed: Feb. 2, 1990

[30] Foreign Application Priority Data

Feb. 8, 1989 [AT] Austria ..... 267/89

[51] Int. Cl.[5] ..... B61B 12/10

[52] U.S. Cl. ..... 104/178; 310/268

[58] Field of Search ..... 104/35, 38, 44, 117.1, 104/173.2, 178, 197; 198/619, 805; 310/156, 268

[56] References Cited

U.S. PATENT DOCUMENTS

| | | | |
|---|---|---|---|
| 2,677,331 | 5/1954 | Hauseman | 104/178 X |
| 2,938,472 | 5/1960 | Tiegel | 104/178 X |
| 4,003,314 | 1/1977 | Pearson | 104/178 X |
| 4,624,617 | 11/1986 | Belna | 104/282 X |
| 4,662,282 | 5/1987 | Fukuwatari | 104/38 |
| 4,781,286 | 11/1988 | Weaver | 198/619 X |
| 4,943,748 | 7/1990 | Schiozawa | 310/268 X |
| 4,949,000 | 8/1990 | Peterson | 310/156 X |

FOREIGN PATENT DOCUMENTS

| | | | |
|---|---|---|---|
| 1350082 | 11/1987 | U.S.S.R. | 198/805 |

*Primary Examiner*—Robert J. Oberleitner
*Assistant Examiner*—S. Joseph Morano
*Attorney, Agent, or Firm*—Herbert Dubno

[57] ABSTRACT

A cable railway installation comprising cable return disks (2) arranged at the bottom and top stations, at least one of which disks (2) is driven, and comprising a carrying and hauling cable (3) arranged around the cable return disks (2) and guided over guide or deflecting rolls (12) for moving transportation means, such as seats (5). The cable return disk (2) forms the rotor of the drive motor, especially a reluctance motor.

4 Claims, 2 Drawing Sheets

CABLE TRANSPORT APPARATUS

FIELD OF THE INVENTION

The invention relates to a cable railway installation comprising cable return disks arranged at the top and bottom stations. At least one cable return disk is constructed with a drive, and comprises a carrying and hauling cable guided around the cable return disks and over guide or deflecting rollers for moving transportation means such as seats, cars and other transportation means, e.g. buckets.

BACKGROUND OF THE INVENTION

With known cable railway installations of this type, a drive motor is provided either at the bottom station or at the top station. By means of the motor, the cable return disk is driven via a set of gears and coupling. A set of gears is necessary to reduce the speed of rotation of the cable return disk with which the carrying and hauling cable is moved. However, such a drive is disadvantageous, since in addition to the electric motor it is necessary to provide the set of gears and a coupling which prove to break down, and also because of noise caused by the set of gears and finally since these components are liable to wear, for which reason they are again liable to break down.

OBJECTS OF THE INVENTION

It is therefore the object of the invention to develop an apparatus eliminating the drawbacks of the known devices. Yet another object is to provide a drive for a cable railway without utilizing elements causing an unreliable operation of the apparatus.

SUMMARY OF THE INVENTION

According to the invention, the cable return disk either forms the rotor of the drive motor, especially a reluctance motor, or is coupled therewith for direct drive. A reluctance motor consists of a stator and a rotor, a group of electromagnets being arranged on the stator with which a group of permanent magnets or electromagnets on the rotor is associated. By successive excitation of the electromagnets arranged next to each other on the stator a rotating field is generated, by means of which the rotor is rotated.

Owing to the construction according to the invention of the cable return disk as a rotor of the drive motor or as the direct coupling of the cable return disk with the rotor of the drive motor, it is possible to dispense with the arrangement of a set of gears and a coupling. In this way, the disadvantages caused by a set of gears and a coupling are avoided. Not only noise is eliminated, but also the structure does not need to be maintained by lubrication, etc. The speed of rotation of a reluctance motor can be controlled simply and continuously. Moreover, stoppage of the motor can never be caused by breakage of components.

According to a preferred embodiment, a group of permanent magnets or electromagnets is arranged on the cable return disk, which group has a ring of electromagnets associated with it on the stator, and which is attached to the carrier of the cable return disk, the ring of electromagnets enables a rotating magnetic field to be generated. However, it is also possible to provide electromagnets on the rotor, by means of which the rotating field can be generated. The top of the cable return disk is preferably constructed with at least one group of annularly arranged magnets associated with a ring of electromagnets carried by the return disk carrier and generating a rotating field. The top of the cable return disk is enclosed by a captype housing. At least one guide groove for the carrying and hauling cable can be provided either at the outer circumference of the cable return disk or on an additional ring arranged on its underside.

BRIEF DESCRIPTION OF THE DRAWING

The above and other features, objects and advantages of the invention, will become more readily apparent from the following description being made to the accompanying drawings, in which.

SPECIFIC DESCRIPTION

Figure 1:
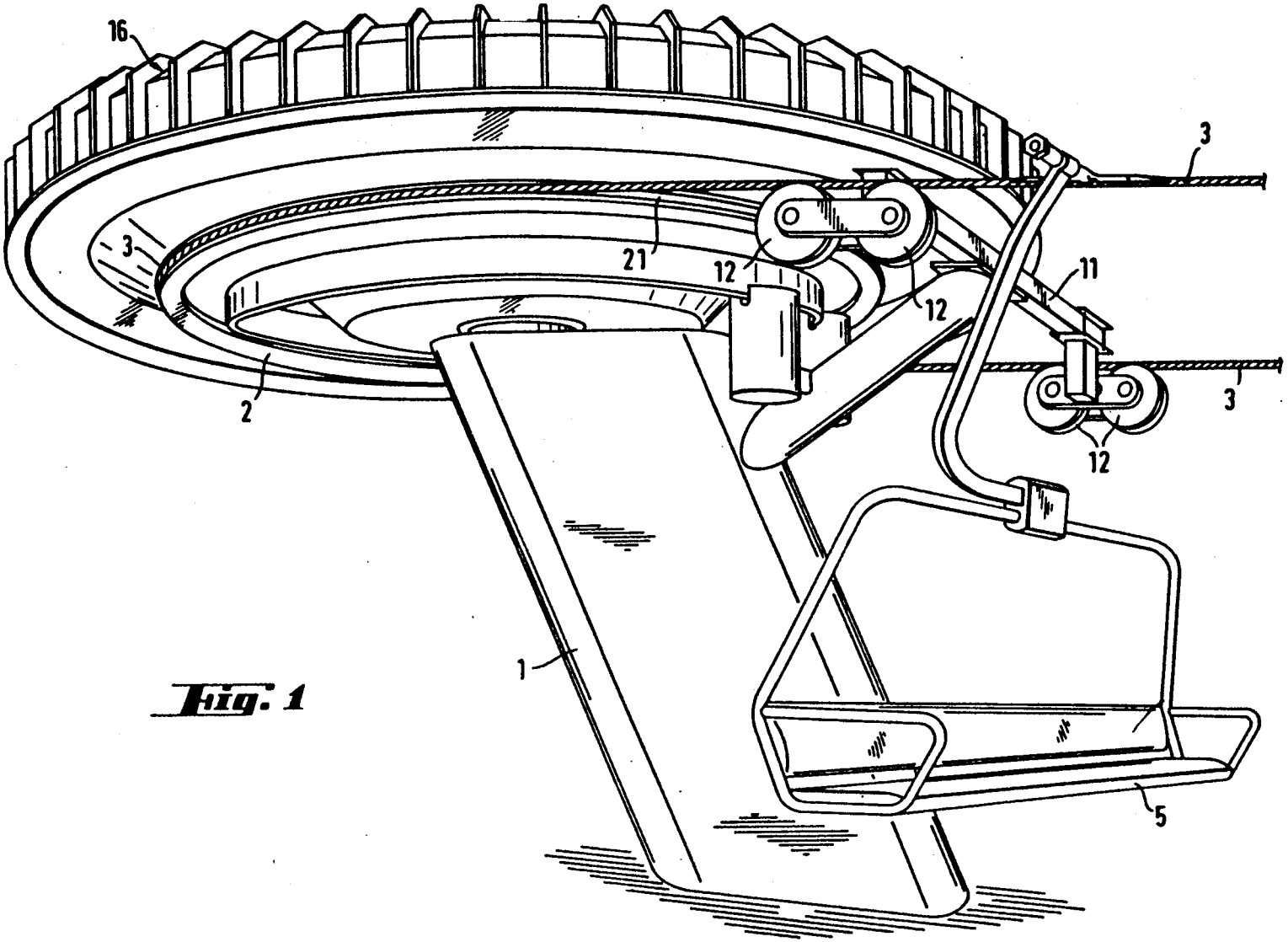
FIG. 1 is an axonometric representation of a cable return disk with a drive according to the invention.

FIG. 1 shows a column 1 provided as a carrier or suppport for a cable return disk 2. The cable return disk 2 is constructed on its underside with a guide groove 21 for the carrying and hauling cable 3. Furthermore, guide or training rolls 12 are accommodated on the carrier 1 by means of a frame 11. Seats 5 are coupled to the carrying and hauling cable 3.

Figure 2:
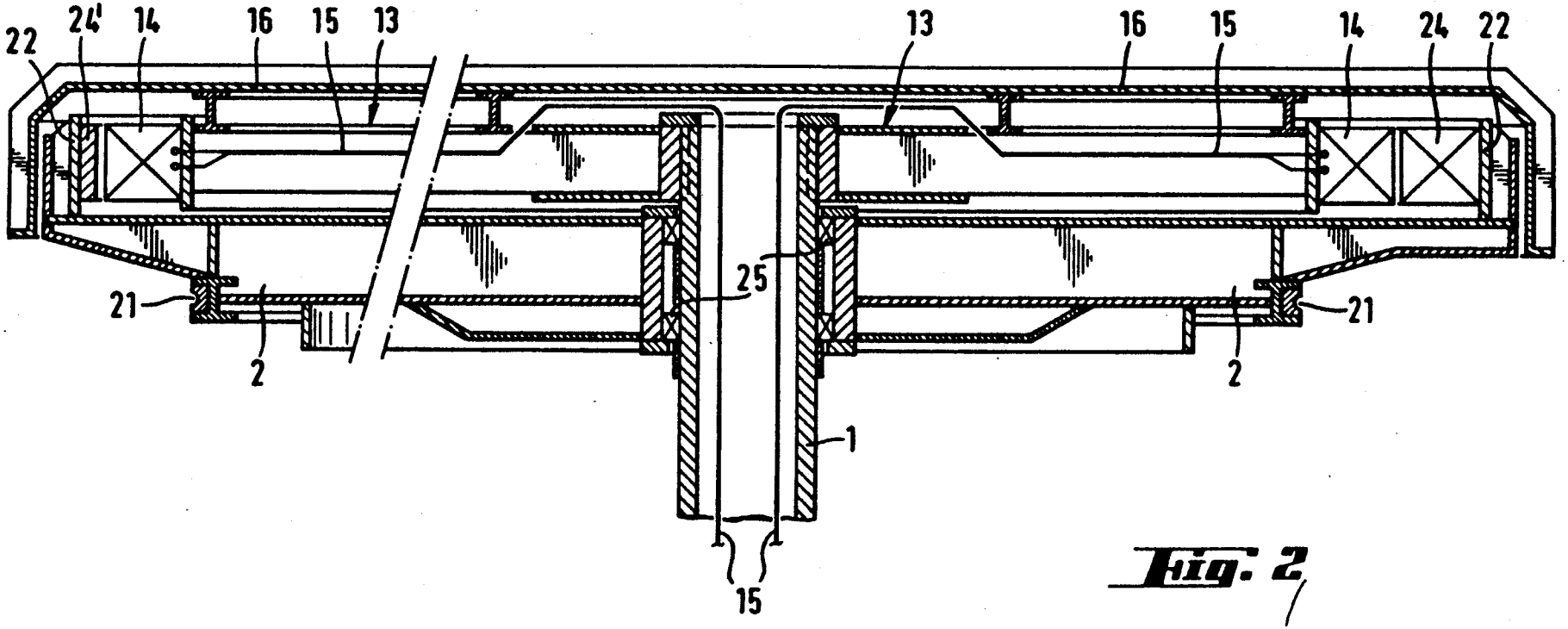
FIG. 2 is an axial section of the cable return disk according to FIG. 1.

As may be seen from FIG. 2, the cable return disk 2 is constructed at its outer circumferential edge with an upwardly projecting flange 22, on the inside of which at least one group of electromagnets 24 or permanent magnets 24' is arranged next to each other. A disk-shaped plate 13 is also attached to the carrier 1, on the outer circumference of which plate 13 there is arranged a plurality of annularly arranged electromagnets 14. The electromagnets 14 are connected via control lines 15 to a supply and control circuit. The cable return disk 2 can be rotated with respect to the carrier 1 by means of a bearing 25.

This arrangement provides a reluctance motor the stator of which is formed by the disk 13 with the electromagnets 14 and the rotor of which is formed by the cable return disk 2 with the magnets 24, 24'. The rotation of the cable return disk 2 is effected by a rotating magnetic field generated by successive excitation of the electromagnets 14 arranged annularly next to each other, the magnetic field attract's repells the magnets 24, 24', whereby the cable return disk 2 acting as the rotor is rotated. In this way, the cable return disk 2 serves as the drive for the carrying and hauling cable 3. A cover 16 is provided above the cable return disk 2.

Finally, it should be pointed out that the rotating field can also be generated by the electromagnets 24 arranged on the cable return disk 2 while mounting permanent magnets on the disk 13. Supply of the electromagnets is effected via slip rings. Moreover, instead of a carrying column it is possible to provide a carrying frame, which is attached to the roof of the station.

Another variant consists of the cable return disk being coupled to the rotor of the drive motor via an optionally flexible shaft for direct drive.

We claim:

1. A cable railway having at least one station, a cable and at least one carrier displaceable on said cable, said station comprising:

a housing formed with a support;

an inner ring mounted on said support in said housing and having an axis, said inner ring being formed with an outer periphery provided with a first plurality of magnets spaced angularly from one another on said outer periphery;

an outer ring mounted rotatably on said support and coaxial with said inner ring, said outer ring being formed with a flange extending parallel to said axis, said flange being formed with an inner peripheral surface and an outer peripheral surface, said inner peripheral surface being juxtaposed with said outer periphery of said inner ring and carrying a second plurality of magnets spaced angularly and juxtaposed with said first plurality of magnets, said outer peripheral surface of said outer ring being formed with means for guiding said cable transporting said carrier to or from said station; and circuit means for selectively energizing said first plurality of magnets, so that said outer ring is rotated causing the cable to be driven upon energizing said first plurality of magnets.

2. The transport assembly defined in claim 1 wherein said magnets of said first plurality are electromagnets, said magnets of said second plurality being permanent magnets.

3. The transport assembly defined in claim 1 wherein said means for guiding include a groove receiving the cable carrying said carrier.

4. The transport assembly defined in claim 1 wherein magnets of said second plurality are electromagnets.

* * * * *